US011945562B1

(12) United States Patent
Kipnis

(10) Patent No.: US 11,945,562 B1
(45) Date of Patent: Apr. 2, 2024

(54) SHOVEL BLADE AIRPLANE/BOAT PROPELLER

(71) Applicant: Cyclazoom, LLC, Skokie, IL (US)

(72) Inventor: Michael Kipnis, Skokie, IL (US)

(73) Assignee: Cyclazoom, LLC, Skokie, IL (US)

( * ) Notice: Subject to any disclaimer, the term of this patent is extended or adjusted under 35 U.S.C. 154(b) by 0 days.

(21) Appl. No.: 18/470,534

(22) Filed: Sep. 20, 2023

(51) Int. Cl.
*B63H 1/16* (2006.01)
*B63H 1/26* (2006.01)

(52) U.S. Cl.
CPC ..... *B63H 1/16* (2013.01); *B63H 1/26* (2013.01)

(58) Field of Classification Search
CPC .. B63H 1/16; B63H 1/26; F01D 5/143; F01D 5/225; F04D 29/164; F04D 29/282; F04D 29/283; F04D 29/326
USPC ..... 416/185, 189, 191, 192
See application file for complete search history.

(56) References Cited

U.S. PATENT DOCUMENTS 1,518,501 A * 12/1924 Wainwright ..... F04D 29/181 416/189
3,112,610 A 12/1963 Jerger
4,147,472 A * 4/1979 Kling ..... F03D 1/0608 416/189
4,370,096 A 1/1983 Church
5,044,884 A * 9/1991 Thibault ..... B63H 1/16 416/189
5,405,243 A * 4/1995 Hurley ..... B63H 1/16 416/189
8,550,782 B2 * 10/2013 Hoskins ..... F04D 29/164 416/235
2014/0363298 A1 * 12/2014 Kehr ..... B63H 1/26 416/192
2015/0369046 A1 * 12/2015 Roberge ..... F01D 5/3069 29/889.21
2020/0070965 A1 3/2020 Bertels

FOREIGN PATENT DOCUMENTS

ES 34947 U 2/1953
GB 335670 A 10/1930
GB 460781 A 8/1935

* cited by examiner

*Primary Examiner* — Matthew W Jellett
(74) *Attorney, Agent, or Firm* — Brian Rolfe

(57) ABSTRACT

Propeller for an airplane or boat includes a rotatable hub attachable to a power axle, a ring structure including an inner ring spaced apart from and connected to the hub, and shovel blades fixed to the inner ring. Each shovel blade is connected at an inner lateral edge to an outer surface of the inner ring and is angled rearward. The shovel blades are spaced apart from one another such that a leading edge of each shovel blade does not overlie a trailing edge of an immediately adjacent shovel blade and the trailing edge of each shovel blade does not underlie the leading edge of an immediately adjacent shovel blade. There may be an outer ring around the shovel blades, or separated blade guides on an opposite side of the shovel blades from the inner ring with each blade guide being associated with a respective shovel blade.

19 Claims, 7 Drawing Sheets

SHOVEL BLADE AIRPLANE/BOAT PROPELLER

FIELD OF THE INVENTION

The present invention relates to a propeller for an airplane or boat, or other propelled vehicles.

BACKGROUND OF THE INVENTION

A typical prior art propeller 100 for an airplane is shown in FIG. 1 and includes a hub 102 and blades 104 that extend equiangularly from the hub 102. The inherent structure of the blades 104 causes the formation of parasitic loss areas 106 between the blades 104 during operation. Also, centrifugal forces, represented by arrows 108, push air out to the sides, spreading air and reducing the efficiency of the propeller 100, and also increasing parasitic losses. As such, the revolutions per minute (RPM) of the propeller 100 is often limited.

Another design of a propeller is in British Patent Specification No. 335,670 (Killen). The Killen patent publication describes a propeller having two spaced apart rotary supports and pivotal blades or planes between the rotary supports. The pivotal blades swivel about radially projecting spokes based on centrifugal force and the pressure of wind on the blades.

OBJECTS AND SUMMARY OF THE INVENTION

It is an object of at least one embodiment of the present invention to provide new and improved propellers for airplanes and boats.

It is another object of at least one embodiment of the present invention to provide new and improved propellers that avoid limitations on the RPMs of conventional propellers, and increase efficiency.

In order to achieve one or more of these objects, and possibly others, a propeller in accordance with the invention includes a rotatable hub, a ring structure including an inner ring spaced apart from the hub, and a plurality of shovel blades fixed to the inner ring, and connection means for connecting the inner ring to the hub through a space between the inner ring and the hub. Each shovel blade is connected at an inner lateral edge to an outer surface of the inner ring and angled rearward, i.e., toward a power axle that is connected to or integral with the hub. The shovel blades are spaced apart from one another in a circumferential direction such that a leading edge of each shovel blade does not overlie a trailing edge of an immediately adjacent shovel blade and the trailing edge of each shovel blade does not underlie the leading edge of an immediately adjacent shovel blade.

In one embodiment, the ring structure includes an outer ring spaced apart and outward from the inner ring. The inner and outer rings are concentric and have a central axis that is common with a central axis of the hub. The shovel blades are fixed to the outer ring, and each shovel blade is connected at an outer lateral edge to an inner surface of the outer ring. As such, the shovel blades are entirely between the inner and outer rings and no part of the shovel blades extends forward of a front edge of the inner and outer rings or rearward of a rear edge of the inner and outer rings. The inner and outer rings may each include a tubular wall having a common central axis. Alternatively, while the inner ring includes a tubular wall, the outer ring is tapered outward in a direction toward a front edge of the outer ring such that the front edge of the outer ring is radially outward of a rear edge of the outer ring. In both embodiments, the tubular wall of the inner ring has a central axis aligning with a central axis of the hub and a central axis of the outer ring.

The connection means may include a plurality of rigid, elongate connector rods each connected at a first longitudinal end to an inner surface of the inner ring and at a second longitudinal end opposite the first longitudinal end to the hub. The connector rods are spaced equiangularly around the hub, and may be arranged to connect to the inner ring opposite a location at which a respective portion of the shovel blades is situated.

In another embodiment, the ring structure includes a plurality of separated blade guides on an opposite side of the shovel blades from the inner ring. Each blade guide is associated with a respective shovel blade. The blade guides are configured such that a front edge of each blade guide is radially outward of a rear edge of an adjoining blade guide to form gaps between adjacent blade guides leading into an interior space defined by the ring structure. Optionally, the blade guides are tapered outward in a direction toward the front of the ring structure such that the front of the ring structure is radially outward of a rear of the ring structure. Also, optionally, the blade guides can have a curved inner surface from a front edge to a leading edge of the shovel blades.

The ring structure can have a unitary construction. The hub may be configured to attach to or be integral with a power axle that operatively provides rotational force to the hub and through the hub to the ring structure. There may be only three shovel blades situated equiangularly around the hub.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
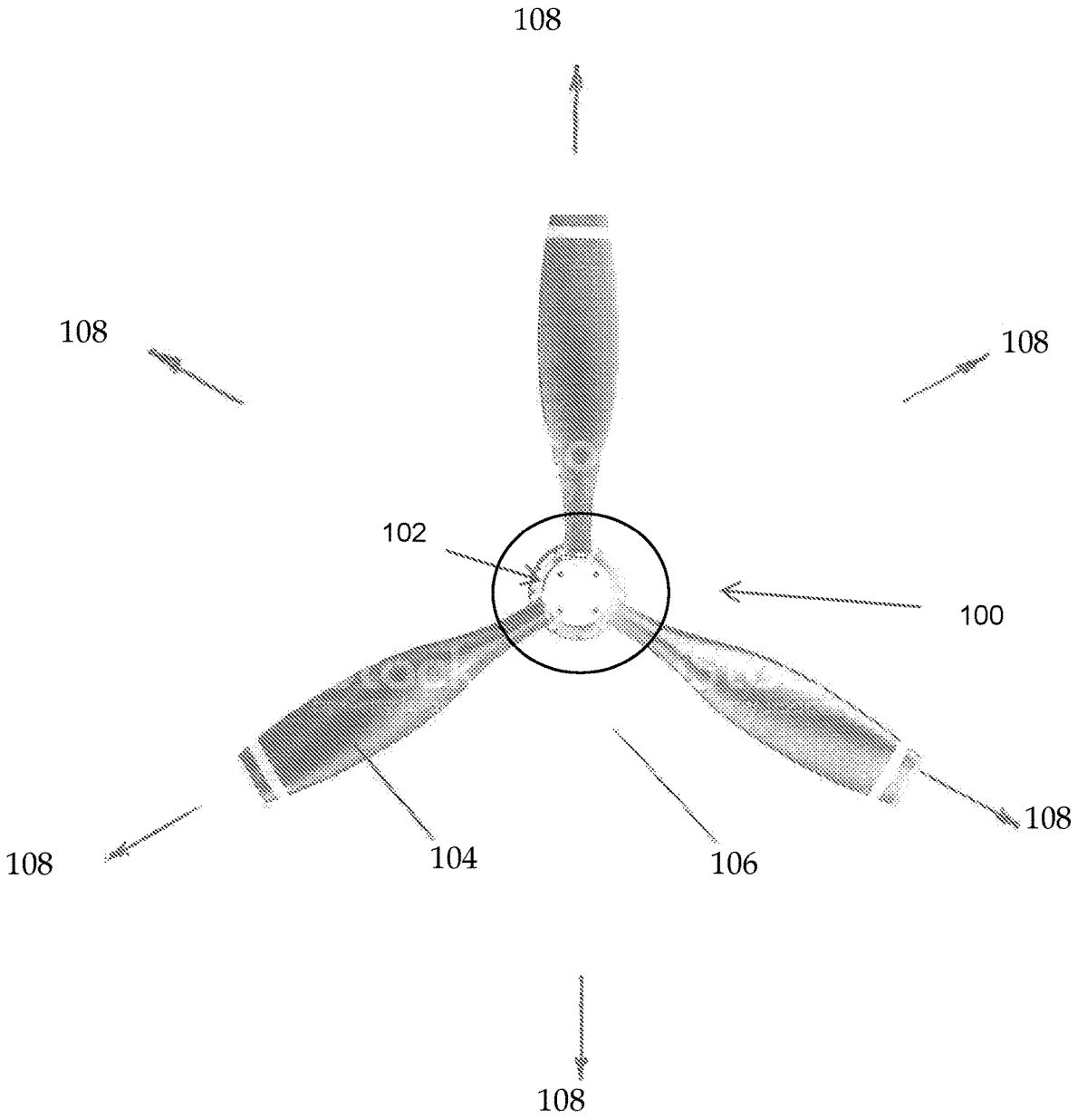
FIG. 1 is a front view of an existing airplane propeller.
Figure 2:
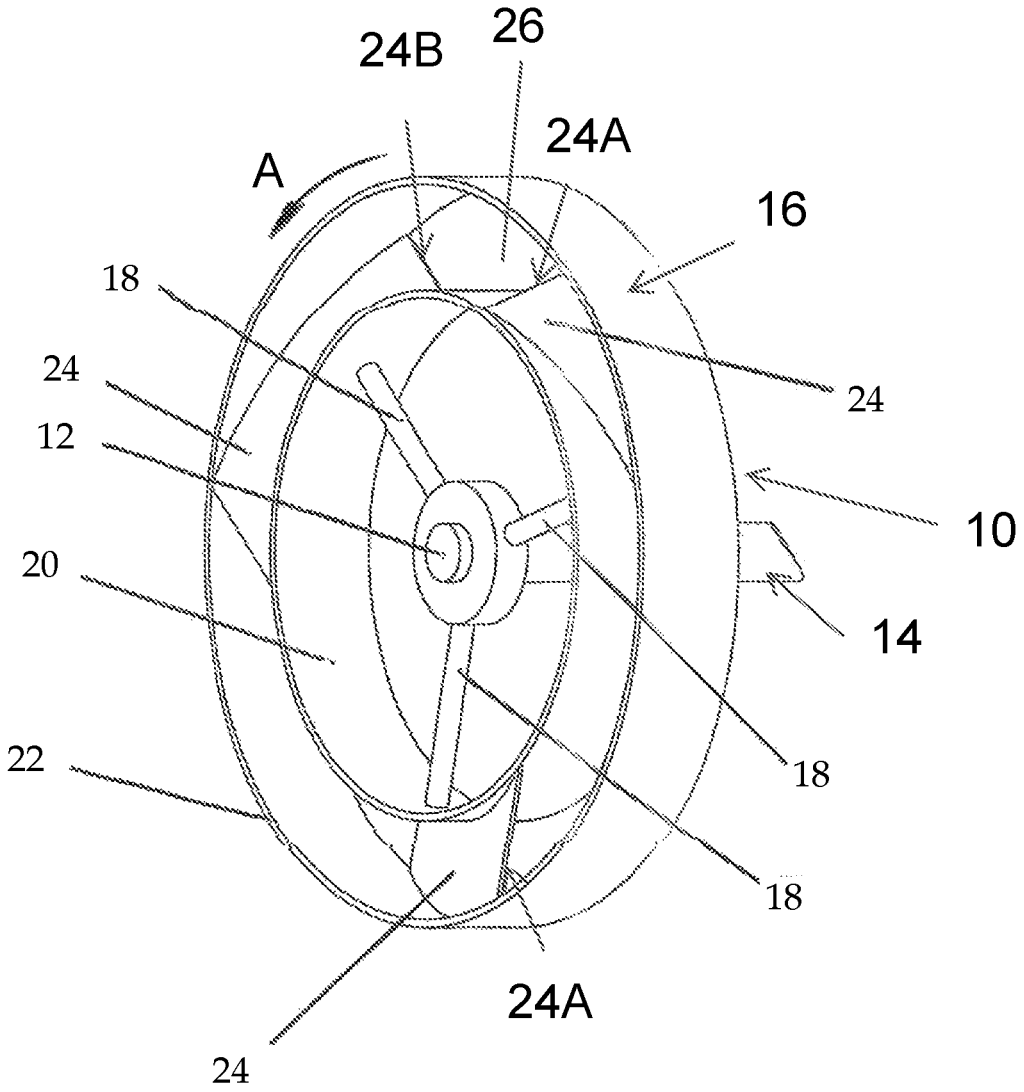
FIG. 2 is a perspective view of a first embodiment of a shovel blade propeller in accordance with the invention.

Referring to the accompanying drawings wherein the same reference numbers refer to the same or similar components, FIGS. 2-5 show a first embodiment of a propeller 10 in accordance with the invention which includes a central hub 12, a power axle 14 connected to or integral with the hub 12 and providing rotational force to the propeller 10, a concentric ring structure 16 spaced apart from the hub 12, and connectors 18 that connector the concentric ring structure 16 to the hub 12 through the space between the hub 12 and the concentric ring structure 16.

The power axle 14 is elongate and extends to one side of the hub 12 and connects to a source of operative, rotational motion. Its connection to a motor or other rotational power unit is conventional in the art and to this end is typically provided with an engagement portion that cooperates with the motor or other rotational power unit to enable rotational energy generated by the motor to be operatively transferred to the power axle 14 and in turn to the hub 12 and ring structure 16.

The ring structure 16 is also considered a shovel blade support assembly and includes an inner ring 20 spaced apart from the hub 12, an outer ring 22 concentric to the inner ring 20 and spaced outward and apart from the inner ring 20, and a plurality of shovel blades 24 entirely between the inner and outer rings 20, 22. The inner and outer rings 20, 22 have a generally tubular construction, i.e., are annular, and thus each has a substantially cylindrical wall. The axis of the cylindrical walls of each of the inner and outer rings 20, 22 are the same, i.e., to thereby provide their concentricity. In the illustrated embodiment, there are three shovel blades 24 situated or spaced equiangularly around the hub 12 in a circumferential direction of the ring structure 16, but this is in no way intended to limit the scope of the invention, and different numbers of shovel blades 24 may be provided in a ring structure 16 in accordance with the invention.

Figure 5:
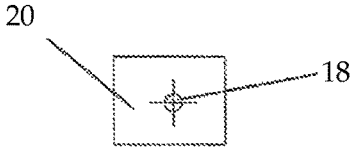
FIG. 5 is a cross-section taken along the line 5-5 in FIG. 3.
Figure 6:
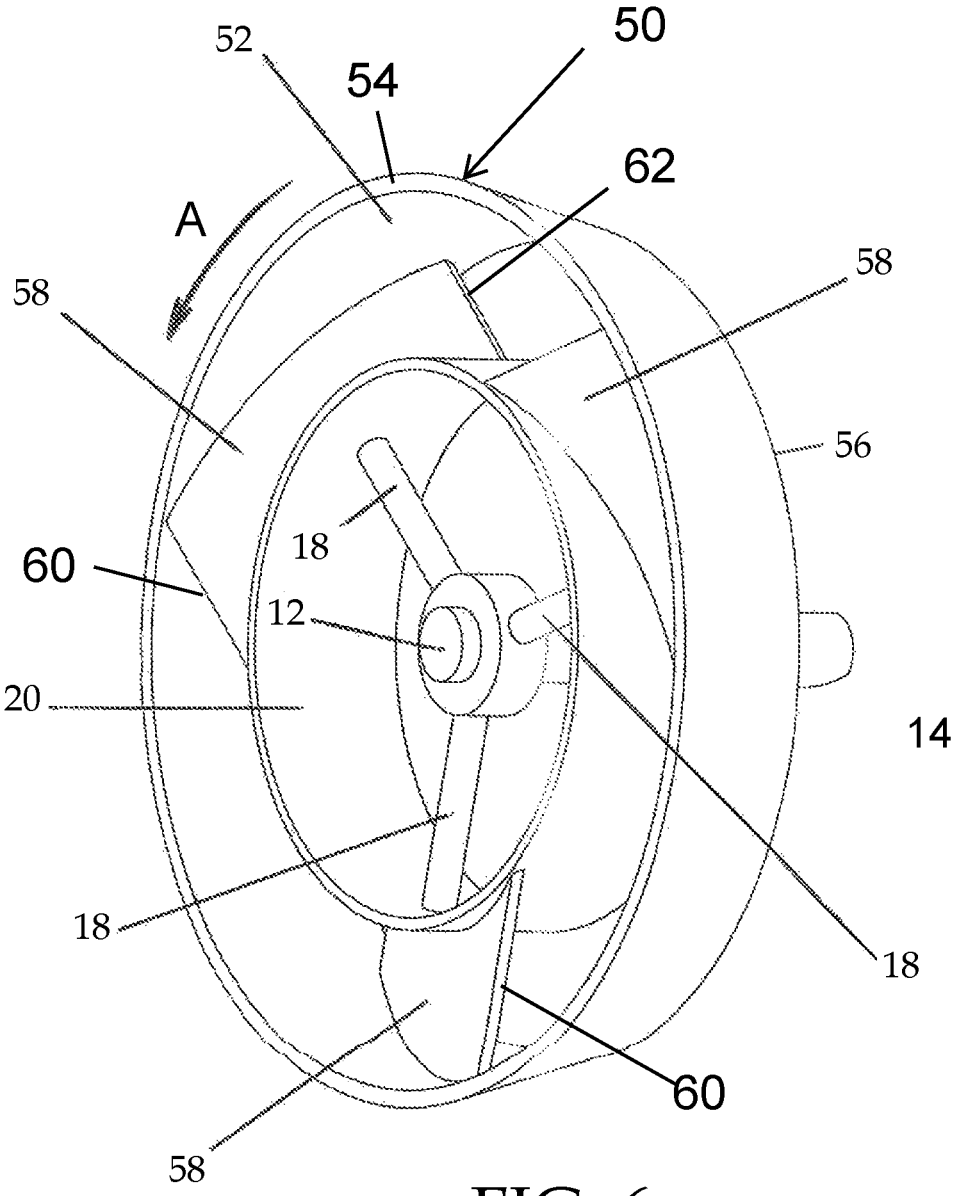
FIG. 6 is a perspective view of a second embodiment of a shovel blade propeller in accordance with the invention.
Figure 7:
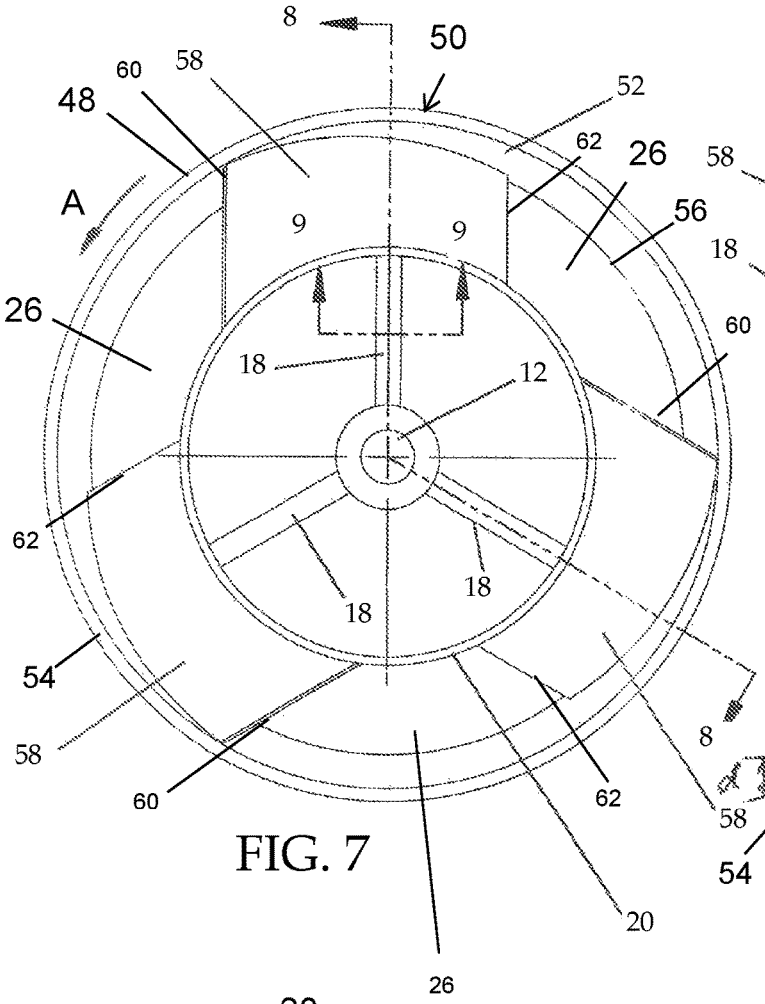
FIG. 7 is a front view of the propeller shown in FIG. 6.
Figure 8:
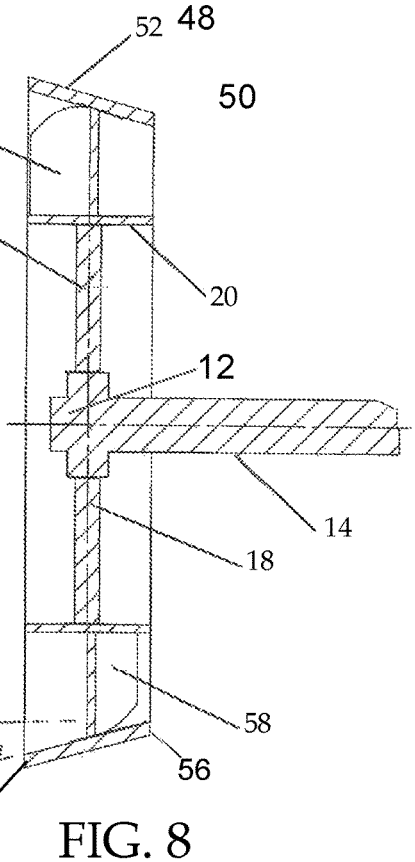
FIG. 8 is a cross-section taken along the line 8-8 in FIG. 7.
Figure 9:
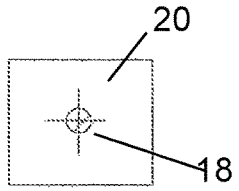
FIG. 9 is a cross-section taken along the line 9-9 in FIG. 7.

The connectors 18 may be elongate rods that connect at an inner longitudinal end to the hub 12 and at an outer longitudinal end to the inner surface of the inner ring 20. The connectors 18 serve to create an inner space 24 inward of the inner ring 20. Connectors 18 are preferably rigid and sufficiently sturdy to support the ring structure 16 on the hub 12 so that rotation of the hub 12 causes rotation of the ring structure 16. Rods used as the connectors 18 may have a circular cross-section as shown in FIG. 5. As used herein, connection means for connecting the hub 12 to the inner ring 20, and more generally the ring structure 16, will include any structure that provides a secure attachment of the inner ring 20 to the hub 12 so that rotation of the hub 12 is conveyed to the inner ring 20 and causes the entire ring structure 16 to rotate. These connection means may include anything from a single structure or multiple and independent connection structure.

As shown, the inner and outer rings 20, 22 can have appropriately the same height, i.e., the cylindrical walls forming each of the inner and outer rings 20, 22 has the same height. However, variations are contemplated in the invention. Thus, the inner and outer rings 20, 22 can have different designs, shapes and heights or widths. The design of each of the inner and outer rings 20, 22 is optimized to minimize parasitic losses and maximize efficiency. The design conditions can be obtained through experimentation. One design criteria for the outer ring 22 is that its purpose is to prevent spreading of air/water and thereby increase efficiency of the propeller 10. To this end, it may be configured to have a greater height than the height of the shovel blades 24. Also, the outer ring 22 reduces turbulence on the edge of the ring structure 16 and its design could be optimized to this end as well.

The shovel blades 24 are fixed to the inner and outer rings 20, 22, i.e., the inner lateral edge of each shovel blade 24 is attached to or formed integral with the outer surface of the inner ring 20 and the outer lateral edge of each shovel blade 24 is attached to or formed integral with the inner surface of the outer ring 22. The lateral edges are those edges in the radial inward and outward directions from a center of the shovel blade 24. By fixing, it is meant that the shovel blades 24 do not swivel, pivot, or move relative to the inner and outer rings 20, 22, Rather, the shovel blades 24 move in combination as a unit with the inner and outer rings 20, 22, i.e., the entire ring structure 16 constitutes and moves as a unit or is unitary. It can also be formed as a single unit, e.g., by laser printing or other comparable fabrication methods.

The shovel blades 24 are angled in the same direction based on the operative direction of rotation of the propeller 10. When the propeller 10 is configured to rotate counterclockwise in the direction of arrow A, a leading edge 24A of each shovel blade is at or adjacent to a front edge of the inner and outer rings 20, 22 while a trailing edge 24B of each shovel blade 24 is at or adjacent to a rear edge of the inner and outer rings 20, 22. Also, the leading edges 24A of the shovel blades 24 are preferably angled so that the leading edge 24A forms an obtuse angle with the outer surface of the inner ring 20 in the space 26 and an acute angle with the inner surface of the outer ring 22 in the space 26.

Figure 3:
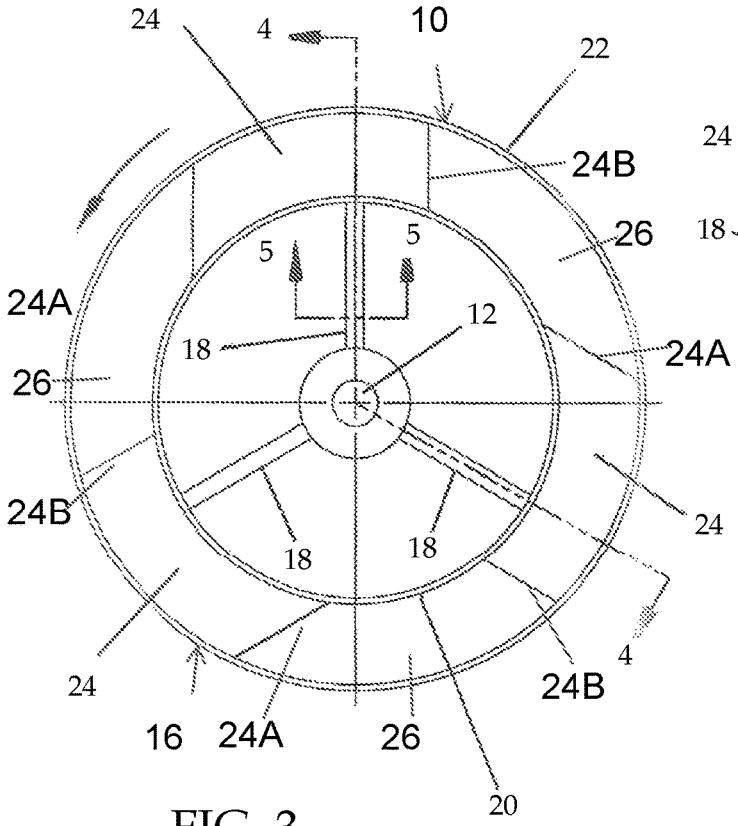
FIG. 3 is a front view of the propeller shown in FIG. 2.

The shovel blades 24 are also separated from one another and do not overlap so that there is a space 26 between the trailing edge 24B of each shovel blade 24 and the leading edge 24A of the adjacent shovel blade 24 (see FIG. 3). By spacing the shovel blades 24 apart from one another, the leading edge of each shovel blade 24 does not overlie the trailing edge of an immediately adjacent shovel blade 24 closest to the leading edge, and the trailing edge of each shovel blade 24 does not underlie the leading edge of an immediately adjacent shovel blade 24 closest to the trailing edge.

FIG. 3 also shows a preferred construction wherein the connectors 18 attach to the inner ring 20 at a location where a portion of the shovel blade 24 is on an opposite side of the inner ring 20. This helps to provide support for the shovel blades 24. The shovel blades 24 occupy about one-half the area between the inner and outer rings 20, 22, so that the cumulative area of the spaces 26 is about the same as the cumulative area of the shovel blades 24, but this is not an essential feature of the propeller 10.

Figure 4:
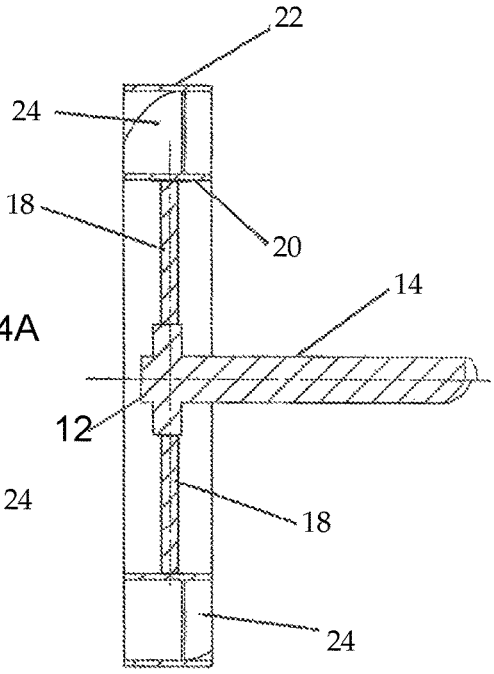
FIG. 4 is a cross-section taken along the line 4-4 in FIG. 3.

As seen in FIG. 4, the connectors 18 have a smaller height than the height of the cylindrical wall forming the inner ring 20, but this is not an essential feature of the propeller 10. Although the connectors 18 are depicted as being a separate component from the hub 12, yet connected thereto, it is possible to form the hub 12 and connectors as a unitary or integral component, e.g., by laser printing the component.

Referring now to FIGS. 6-9 wherein the same reference numbers refer to the same elements as in propeller 10, another embodiment of a propeller in accordance with the invention is designated generally as 50 and is similar to propeller 10 with the notable exception that the outer ring 52 of a ring structure 48 tapers radially outward so that its axial front edge 54 is radially outward of the axial rear edge 56. The angle of taper a of the outer ring 52, in the radially outward direction from the axial rear edge 56 to the axial front edge 54 toward the axial front edge 56, is designated a in FIG. 8 and its magnitude is variable and can be determined experimentally, without undue experimentation, by constructing different propellers with different taper angles and determining which provides the best operating conditions relative to the desired operating environment.

Since shovel blades 58 are connected at their side edges to the outer surface of the inner ring 20 and to the inner surface of the outer ring 52, the shovel blades 58 have a wider leading edge 60 than their trailing edge 62, and therefore their width is gradually reduced from the leading edge 60 to the trailing edge 62. The central axis of the outer ring 52 is still the same as the central axis of the inner ring 20, which is also the central axis of the hub 12. Shovel blades 58 thus do not have a uniform width as do shovel blades 24.

Figure 10:
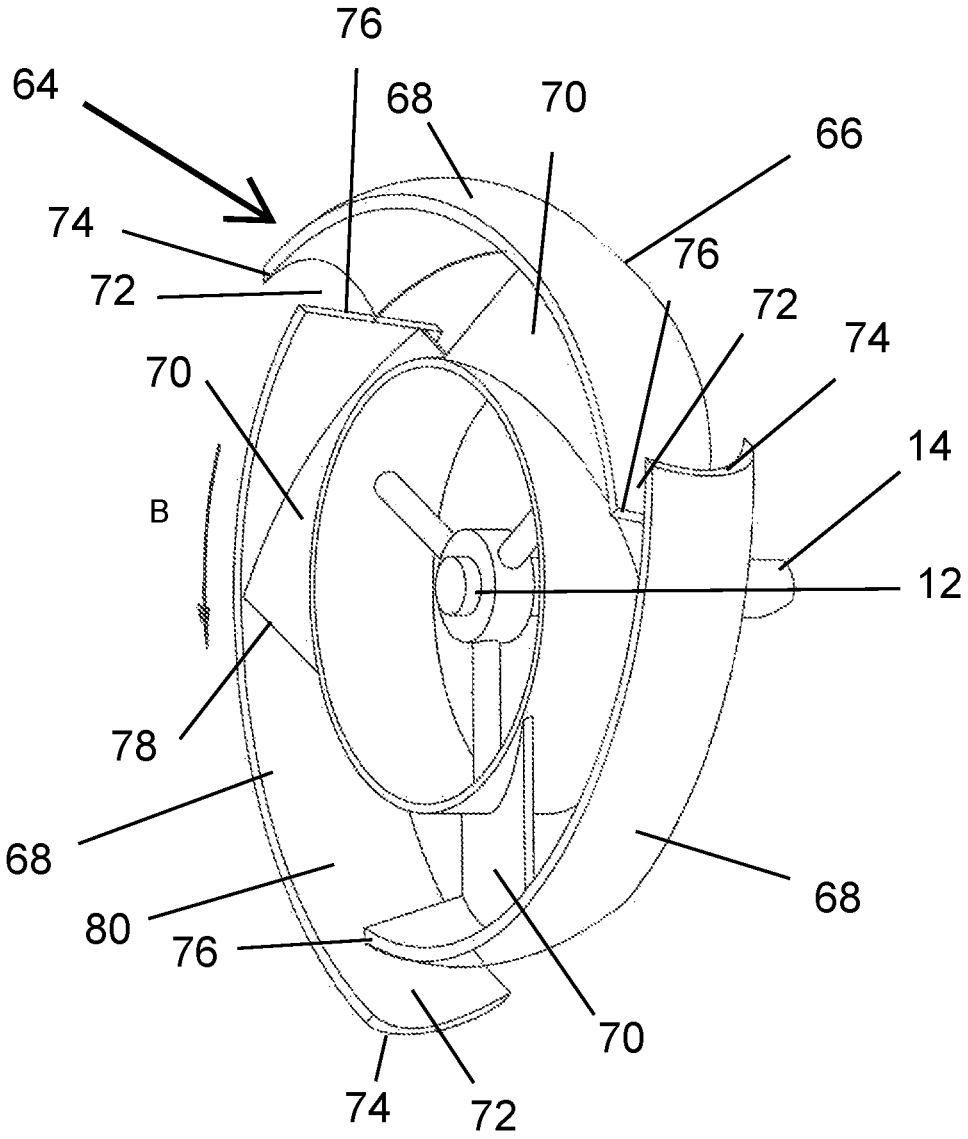
FIG. 10 is a perspective view of a third embodiment of a shovel blade propeller in accordance with the invention.
Figure 11:
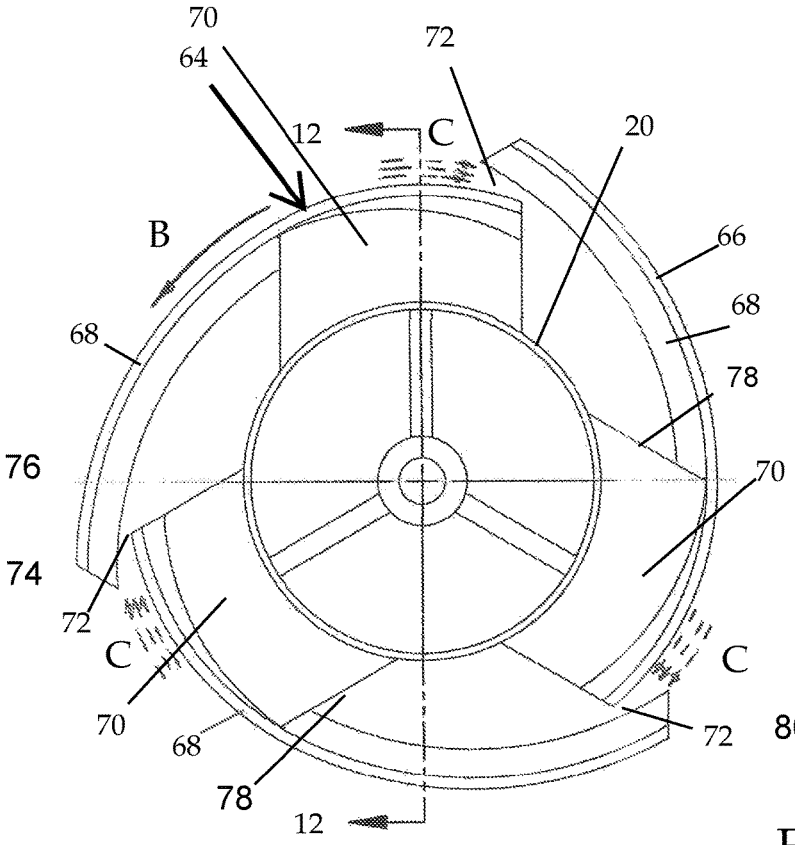
FIG. 11 is a front view of the propeller shown in FIG. 10.
Figure 12:
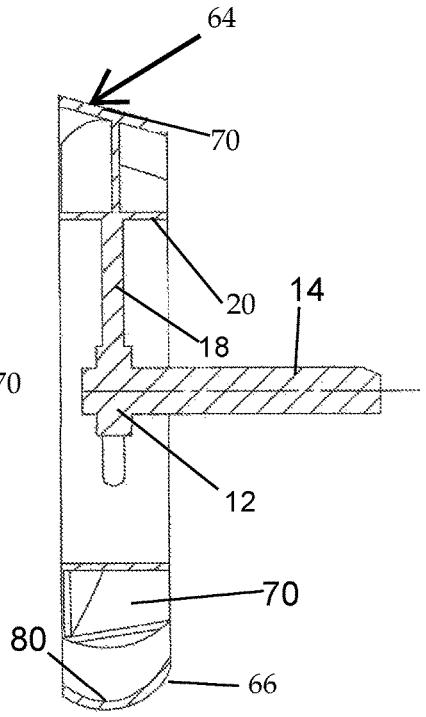
FIG. 12 is a cross-section taken along the line 12-12 in FIG. 11.

FIGS. 10-12 show a variant of the propellers 10, 50 described above wherein a propeller 64 is provided that includes, instead of an outer ring 22, 52 that is concentric with the inner ring 20 as in propellers 10, 50 respectively, a ring structure 66 having a plurality of separated blade guides 68, one associated with each shovel blade 70, i.e., there is a blade guide and only one blade guide fixed to or integral with each respective shovel blade 70.

The blade guides 68 are on an opposite side of the shovel blades 70 from the inner ring 20. The blade guides 68 are separated from one another in the sense that they are not connected to one another around the periphery or circumference of the ring structure 66 and therefore there are gaps 72 between the front edge 74 of each blade guide 68 and the adjacent rear edge 76 of an adjoining blade guide 68. A portion of each blade guide 68 including the front edge 74 circumferentially overlies or overlaps the adjacent rear edge 76 of the adjoining blade guide 68 so that the gaps 72 are radially outward of the rear edge 76 of one blade guide 68 and radially inward of the portion including the front edge 74 of the overlying or overlapping blade guide 68.

The rear edges 76 of the blade guides 68 may be contiguous or align with the rear edge of the associated shovel blade 70. As such, the gaps 72 are open immediately after the shovel blades 70 in the direction of rotation of the propeller 64. The blade guides 68 are tapered outward in a direction toward the front of ring structure 66 such that the front of the ring structure 66 is radially outward of a rear of the ring structure 66.

Blade guides 68 have a variable cross-section shape, changing from having opposed planar surfaces in a section along the shovel blades 70 to having opposed curved surfaces from the leading edges 78 of the shovel blades 70 the front edge 74 of the blade guide 68. The transition from the rear edge 76 of the blade guide 68 to the front edge 74 may be a gradual transition. The end result is that the blade guides 68 present an inner curved surface 80 alongside the gaps 72, forming a channel facing the hub 12, to improve the medium flow into the ring structure 66 and guide the medium along the inner curved surfaces 80 of the blade guides 68 to the shovel blades 70 (see FIG. 12).

Gaps 72 are designed to allow medium flow represented by arrows C into an interior space defined by the ring structure 66, and specifically to an area adjacent to and along the inner curved surfaces 80 of the blade guides 68 and in front of the shovel blades 70 during rotation of the propeller 64 (see arrows B in FIGS. 10 and 11) and therefore improve operating performance of the propeller 64. By contrast, in propellers 10, 50, since the outer rings 22, 52 are solid, they do not allow medium flow into the interior space defined by the ring structure 16, 48 from an area radially outward of the ring structure 16, 48, but rather only allow medium flow into the interior of the ring structure 16, 48 in an axial direction of the ring structure 16, 48, i.e., notably from the front side of the ring structure 16, 48 to cause propulsion during counterclockwise rotation of the propellers 10, 50.

Propellers 10, 50, 64 can be attached to airplanes, boats and any other vehicle that can be propelled by rotation of a propeller. The manner of attachment is via the power axle 14. Alternatively, other structures may be used to attach the hub 12 to the vehicle, and all such attachment structure is considered to be included in the scope of the invention.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. Furthermore, the absence of structure in the drawings may be, in some embodiments, considered to indicate that such structure is intentionally lacking and omitted in an engine or other arrangement disclosed herein. The absence of such structure can, in some embodiments, provide benefits.

The invention claimed is:

1. A propeller, comprising:

a rotatable hub;

a ring structure including an inner ring spaced apart from said rotatable hub, shovel blades fixed to said inner ring, and an annular, outer ring spaced apart and radially outward from said inner ring, said outer ring being tapered at an angle radially outward from an axial rear edge of said outer ring to an axial front edge of said outer ring in a direction toward the axial front edge of said outer ring such that the axial front edge of said outer ring is radially outward of the axial rear edge of said outer ring, each of said shovel blades being connected at an inner lateral edge to an outer surface of said inner ring, being connected at an outer lateral edge to an inner surface of said outer ring, and being angled rearward, said shovel blades being spaced apart from one another in a circumferential direction such that a leading edge of each of said shovel blades does not overlie a trailing edge of an immediately adjacent one of said shovel blades and the trailing edge of each of said shovel blades does not underlie the leading edge of an immediately adjacent one of said shovel blades; and connection means for connecting said inner ring to said rotatable hub through a space between said inner ring and said rotatable hub.

2. The propeller of claim 1, wherein said inner and outer rings are concentric and have a central axis that is common with a central axis of said rotatable hub.

3. The propeller of claim 1, wherein said shovel blades are fixed to said outer ring.

4. The propeller of claim 1, wherein said shovel blades are entirely between said inner and outer rings and no part of said shovel blades extends forward of an axial front edge of said inner ring and the axial front edge of said outer ring or rearward of an axial rear edge of said inner ring and the axial rear edge of said outer ring.

5. The propeller of claim 1, wherein said inner and outer rings each comprise a tubular wall having a common central axis.

6. The propeller of claim 1, wherein said inner ring comprises a tubular wall having a central axis aligning with a central axis of said rotatable hub and a central axis of said outer ring.

7. The propeller of claim 1, wherein said connection means comprise rigid, elongate connector rods each connected at a first longitudinal end to an inner surface of said inner ring and at a second longitudinal end opposite the first longitudinal end to said rotatable hub.

8. The propeller of claim 7, wherein said connector rods are spaced equiangularly around said rotatable hub.

9. The propeller of claim 7, wherein said connector rods are arranged to connect to said inner ring opposite a location at which a respective portion of said shovel blades is situated.

10. A propeller, comprising:

a rotatable hub;

a ring structure including an inner ring spaced apart from said rotatable hub, shovel blades fixed to said inner ring and separated blade guides on an opposite side of said shovel blades from said inner ring, each of said shovel blades being connected at an inner lateral edge to an outer surface of said inner ring and being angled rearward, said shovel blades being spaced apart from one another in a circumferential direction such that a leading edge of each of said shovel blades does not overlie a trailing edge of an immediately adjacent one of said shovel blades and the trailing edge of each of said shovel blades does not underlie the leading edge of an immediately adjacent one of said shovel blades; and connection means for connecting said inner ring to said rotatable hub through a space between said inner ring and said rotatable hub, and wherein said blade guides are configured such that a portion including a front edge of each of said blade guides overlies a rear edge of an adjoining one of said blade guides to form gaps in a radial direction of said ring structure between adjacent ones of said blade guides leading into an interior space defined by said ring structure, whereby upon rotation of the propeller, fluid flows into the interior space defined by said ring structure through the gaps and interacts with said shovel blades.

11. The propeller of claim 10, wherein each of said blade guides is associated with a respective one of said shovel blades.

12. The propeller of claim 10, wherein said blade guides are tapered outward in a direction toward a front of said ring structure such that the front of said ring structure is radially outward of a rear of said ring structure.

13. The propeller of claim 10, wherein said blade guides have a curved inner surface forming a channel facing said rotatable hub, said curved inner surface of each of said blade guides extending from a front circumferential edge of said blade guide to a leading edge of a respective one of said shovel blades.

14. The propeller of claim 1, wherein said ring structure has a unitary construction.

15. The propeller of claim 1, wherein said rotatable hub is configured to attach to or is integral with a power axle that operatively provides rotational force to said rotatable hub and through said rotatable hub to said ring structure.

16. The propeller of claim 1, wherein said shovel blades consist of three shovel blades situated equiangularly around said rotatable hub.

17. A propeller, comprising:

a rotatable hub configured to attach to or be integral with a power axle that operatively provides rotational force to said rotatable hub;

a ring structure including an inner ring spaced apart from said rotatable hub, shovel blades fixed to said inner ring and situated equiangularly around said rotatable hub, and an annular, outer ring spaced apart and outward from said inner ring, said outer ring being tapered at an angle radially outward from an axial rear edge of said outer ring to an axial front edge of said outer ring in a direction toward the axial front edge of said outer ring such that the axial front edge of said outer ring is radially outward of the axial rear edge of said outer ring, each of said shovel blades being connected at an inner lateral edge to an outer surface of said inner ring, being connected at an outer lateral edge to an inner surface of said outer ring, and being angled rearward, said shovel blades being spaced apart from one another in a circumferential direction such that a leading edge of each of said shovel blades does not overlie a trailing edge of an immediately adjacent one of said shovel blades and the trailing edge of each of said shovel blades does not underlie the leading edge of an immediately adjacent one of said shovel blades; and rigid, elongate connector rods each connected at a first longitudinal end to an inner surface of said inner ring and at a second longitudinal end opposite the first longitudinal end to said rotatable hub, said connector rods being spaced equiangularly around said rotatable hub and arranged to connect to said inner ring opposite a location at which a respective portion of said shovel blades is situated.

18. The propeller of claim 10, wherein said connection means comprise rigid, elongate connector rods each connected at a first longitudinal end to an inner surface of said inner ring and at a second longitudinal end opposite the first longitudinal end to said rotatable hub, said connector rods being arranged to connect to said inner ring opposite a location at which a respective portion of said shovel blades is situated.

19. The propeller of claim 10, wherein said rotatable hub is configured to attach to or is integral with a power axle that operatively provides rotational force to said rotatable hub and through said rotatable hub to said ring structure.

* * * * *